US008630432B2

(12) United States Patent
Rass

(10) Patent No.: US 8,630,432 B2
(45) Date of Patent: Jan. 14, 2014

(54) SELF-PROGRAMMING HEARING APPARATUS AND CORRESPONDING METHOD

(75) Inventor: Uwe Rass, Nümberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1355 days.

(21) Appl. No.: 12/001,442

(22) Filed: Dec. 11, 2007

(65) Prior Publication Data

US 2008/0137889 A1 Jun. 12, 2008

(30) Foreign Application Priority Data

Dec. 11, 2006 (DE) ..... 10 2006 058 317

(51) Int. Cl.
*H04R 25/00* (2006.01)

(52) U.S. Cl.
USPC ..... 381/314; 381/315

(58) Field of Classification Search
USPC ..... 381/314, 315
See application file for complete search history.

(56) References Cited

U.S. PATENT DOCUMENTS

| | | | |
|---|---|---|---|
| 2006/0188116 A1 | 8/2006 | Frerking et al. | |
| 2007/0047749 A1 | 3/2007 | Kasztelan et al. | |
| 2007/0147641 A1 | 6/2007 | Platz | |
| 2008/0025537 A1 * | 1/2008 | Ritter et al. | 381/314 |

FOREIGN PATENT DOCUMENTS

| | | |
|---|---|---|
| DE | 101 47 811 C1 | 6/2003 |
| EP | 1 389 035 A2 | 2/2004 |
| EP | 1638367 A2 | 3/2006 |
| EP | 1701585 A2 | 9/2006 |
| WO | 2006-074655 A1 | 7/2006 |

OTHER PUBLICATIONS

Automatische Einstellung der Parameter eines mobilen Endgeraets fuer Traeger von Hoergeraeten mit Hilfe von RFID, Poerschmann, Christoph Carstens, Juergen, 2004, US, Oct. 25, 2004.

* cited by examiner

*Primary Examiner* — Yu Chen

(57) ABSTRACT

In one aspect, a programmable hearing apparatus is provided to allow a convenient programming of the hearing apparatus with minimal effort. To this end, programming data is stored in a transponder. The transponder is activated by the hearing apparatus. Consequently, programming data is transmitted from the transponder to the hearing apparatus.

8 Claims, 1 Drawing Sheet

SELF-PROGRAMMING HEARING APPARATUS AND CORRESPONDING METHOD

CROSS REFERENCE TO RELATED APPLICATIONS

This application claims priority of German application No. 102006058317.5 filed Dec. 11, 2006, which is incorporated by reference herein in its entirety.

FIELD OF INVENTION

The present invention relates to a hearing apparatus with a memory for storing data and a transmission facility for wireless communication. Furthermore, the present invention relates to a hearing system with a hearing apparatus of this type as well as a programming unit. Finally, the present invention also relates to a corresponding method for programming the hearing apparatus. The term hearing apparatus is understood here to mean in particular a hearing device, but also for instance a headset or earphones.

BACKGROUND OF INVENTION

Hearing devices are wearable hearing apparatuses used to assist the hard-of-hearing. To meet the numerous individual requirements, different designs of hearing device are provided, such as behind-the ear (BTE) hearing devices, in-the-ear (ITE) hearing devices and concha hearing devices. The typical configurations of hearing device are worn on the outer ear or in the auditory canal. Above and beyond these designs however there are also bone conduction hearing aids, implantable or vibro-tactile hearing aids available on the market. In such hearing aids the damaged hearing is stimulated either mechanically or electrically.

Hearing devices principally have as their main components an input converter, an amplifier and an output converter. The input converter is as a rule a sound receiver, e.g. a microphone, and/or an electromagnetic receiver, e.g. an induction coil. The output converter is mostly implemented as an electroacoustic converter, e.g. a miniature loudspeaker, or as an electromechanical converter, e.g. bone conduction earpiece. The amplifier is usually integrated into a signal processing unit. This basic structure is shown in FIG. 1 using a behind-the-ear hearing device as an example. One or more microphones 2 for recording the sound from the surroundings are built into a hearing device housing 1 worn behind the ear. A signal processing unit 3, which is also integrated into the hearing device housing 1, processes the microphone signals and amplifies them. The output signal of the signal processing unit 3 is transmitted to a loudspeaker or earpiece 4 which outputs an acoustic signal. The sound is transmitted, if necessary via a sound tube which is fixed with an otoplastic in the auditory canal, to the hearing device wearer's eardrum. The power is supplied to the hearing device and especially to the signal processing unit 3 by a battery 5 also integrated into the hearing device housing 1.

Hearing devices and other hearing apparatuses are generally programmed by an acoustician, a hearing device specialist or another person skilled in the art. A prerequisite here consists not only of a certain knowledge but special equipment for programming is also needed.

Hearing devices have previously been programmed using computers and programming devices (NoahLink, HIPRO, etc.). With so-called ultra-low-end devices, trimmers are adjusted on the device "for programming", said trimmers nevertheless requiring a lot of space and rendering the devices expensive.

The publication DE 101 47 811 C1 likewise discloses a method for programming a hearing device. In this case, encoded information is provided on a printed medium and is then accepted by means of a code reading unit. The information is then stored in the hearing device so that the signal processing in the hearing device can be controlled as a function of the stored information. To this end, an electromagnetic signal transmission is triggered to the hearing device by actuating a control element of the code reading unit.

Each of the above-mentioned types of programming represents a high outlay for the hearing device wearer. This is all the greater in countries in which no corresponding infrastructures exist.

The publication EP 1 389 035 A2 discloses a wireless programmable hearing aid device. It features a transponder, with which it is able to wirelessly receive programming signals from a programming device and send back specific response signals. The transponder possesses an electrical coil for this purpose.

SUMMARY OF INVENTION

The object of the present invention thus consists in proposing a hearing apparatus, which can be programmed in a simple and user-friendly fashion. In addition, a corresponding hearing system with a programming unit and a method in this regard is proposed for programming purposes.

In accordance with the invention, this object is achieved by a hearing apparatus with a memory for storing data and a transmission facility for wireless communication, with the transmission facility being designed to emit activation energy for an external transponder and to receive data from the transponder and with it being possible to store the data received by way of the transmission facility in the memory.

Furthermore, provision is made in accordance with the invention for a hearing system to have a so-called hearing apparatus and a transponder, which comprises a programming memory, with it being possible to transmit data from the programming memory to the hearing apparatus by way of the transponder.

Furthermore, a method for programming a hearing apparatus by storing programming data in a transponder, activating the transponder by means of the hearing apparatus and transmitting the programming data from the transponder to the hearing apparatus is also provided in order to achieve the afore-mentioned object.

It is thus advantageously possible to program the hearing apparatus and in particular the hearing device with an RFID transponder, which is cheap to manufacture, without the need for other devices. In particular, the external transponder does not require a special energy supply, since the energy for the adjustment and/or programming originates from the hearing apparatus itself. A passive transponder can thus be used as an adjustment and/or programming device.

The hearing apparatus according to the invention can also comprise a signal processing facility, with it being possible to change only one predetermined part of the parameters of the signal processing facility by the transmitted data which is stored in the memory. This means that a hearing device can for example be realized which possesses a basic setting, with it only fine tuning of the parameters being possible by means of the transponder. A complicated basic setting which was chosen for the individual hearing loss can thus not get accidentally lost because of the easy-to-use programming unit.

The transponder can also possess an adjusting element for manually adjusting a parameter which can be transmitted from the transponder to the hearing apparatus. The responsibility for programming the hearing apparatus can thus again be handed over to the user, without causing too much of a problem.

The hearing apparatus is preferably programmed by simply placing it on the transponder, whereupon it retrieves programming data or other data from the transponder. The retrieval of programming data by the hearing apparatus can be initiated for example by an element on the hearing apparatus being manually actuated. Alternatively, the hearing apparatus can also automatically identify that it is located in the transmission range of the transponder. In the latter case, the space requirement for adjusting elements on the hearing apparatus can be reduced, provided that retrieval is not automatically carried out when the hearing apparatus is switched on.

BRIEF DESCRIPTION OF THE DRAWINGS

The present invention is described in more detail with reference to the appended drawings, in which.

DETAILED DESCRIPTION OF INVENTION

The exemplary embodiment illustrated in more detail below represents a preferred embodiment of the present invention.

Figure 1:
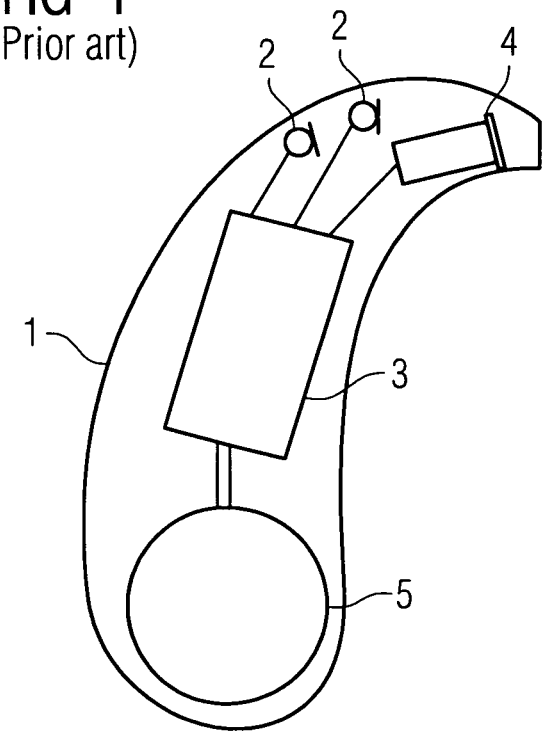
FIG 1 (Prior art)
FIG. 1 shows the basic design of a hearing device.
Figure 2:
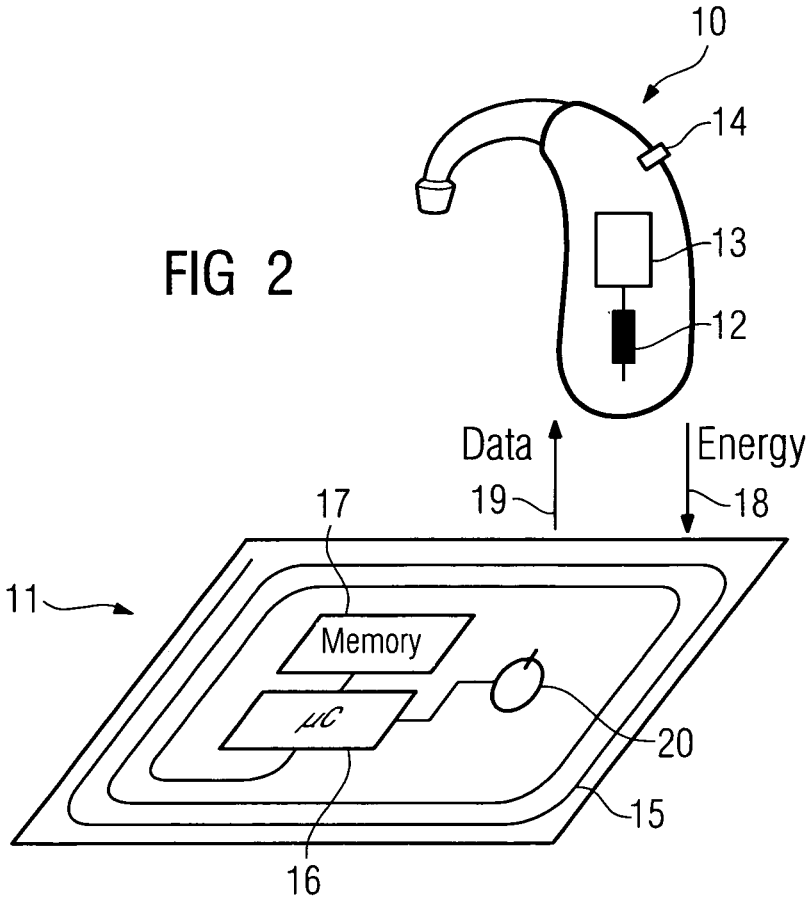
FIG. 2 shows a diagram for the inventive exchange of data for the programming of a hearing device.

According to the example in FIG. 2, a hearing device 10 is to be programmed with a transponder 11. To this end the hearing device 10 possesses a so-called "wireless system" which, aside from data, can also transmit energy to external circuits. This transmission system is symbolized on the part of the hearing device 10 in FIG. 2 by means of an antenna coil 12. The transmission system and/or the antenna coil 12 is connected to a memory 13, in which programming data for the signal processing facility 3 (compare FIG. 1) can be stored. The latter is however not shown in FIG. 2 for the sake of clarity. In addition, the hearing device 10 still has a so-called "pushbutton" 14, which has to be pressed in order to program the hearing device 10.

The transponder 11, in particular an RFID transponder, represents a circuit which is external to the hearing device, said circuit being able to communicate wirelessly with the hearing device 10. To this end, the transponder 11 possesses an antenna 15, which is embodied as a helical coil on a flat substrate, which preferably has the form of a check guarantee card. The antenna 15 is connected to a microcontroller 16 and this is in turn connected to a memory 17. The memory 17 contains the programming data, which is to be transmitted into the memory 13 of the hearing device 10. The microcontroller 16 controls the data transmission on the part of the transponder 11.

The programming of the hearing device 10 by the transponder 11 is illustrated in more detail below in individual steps. For programming purposes, the hearing device 10 is simply placed on the RFID transponder or is brought into its vicinity. The hearing device 10 is then switched on and/or the pushbutton 14 on the hearing device 10 is pressed. The hearing device 10 consequently generates a magnetic field, which supplies the transponder 11 with energy. This is illustrated in FIG. 2 with a corresponding arrow 18. This transmission in the direction from the hearing device 10 to the transponder 11 can include transmission of, but this is not shown in FIG. 2 however.

If the transponder 11 is activated by means of the energy of the hearing device 10, said transponder 11 responds with the programming data sequence, which is stored in the memory 17. The data transmission, which is illustrated with arrow 19 in FIG. 2, is carried out by modulating the magnetic field. In the hearing device, the received data is written into the memory 13, in particular an EEPROM.

The hearing device is thus programmed in accordance with the invention on the initiative of the hearing device. The energy required for this also originates from the hearing device. This means that the hearing device actively fetches the settings from the transponder.

According to a further embodiment, the transponder 11 can also contain a trimmer 20, a switch or a similar actuation element. In addition, the transponder can also comprise a number of adjusting elements of this type. The user thus has the possibility of individually adjusting parameters him/herself and then transmitting these to the hearing device. This can be carried out within the scope of the programming, but also independently thereof. In this way, adjusting elements for modifying parameters on the hearing device can be saved.

In the field, N different transponders can be provided for instance so that N preadjustments of the hearing devices are possible. The hearing device wearer then selects the adjustment which is most favorable to him/her and acquires the corresponding transponder. The adjustment of the hearing device is thus accurate enough to implement the fine turning with a learning hearing device for instance.

An advantageous use of the transponder programming consists of enabling it to be limited to specific parameters. This allows a basic setting of the hearing device, which relates to the individual hearing loss, to be exclusively carried out by the acoustician. To this end, the acoustician has corresponding programming devices, in the simplest case even a transponder as described above. The hearing device wearer can however only acquire transponders him/herself, which are suited to programming specially provided algorithms or features (directional microphone, background noise suppression etc.). It is also possible to only activate certain functions retrospectively by way of an RFID transponder (upgrade).

The invention claimed is:

1. A hearing apparatus possessing a basic setting for an individual hearing loss, comprising:

a memory for storing programming data for the hearing apparatus; and a transmission facility providing wireless communication, wherein the transmission facility emits activation energy for an external transponder and receives adjustment parameter data from the transponder in order to update the programming data in the hearing apparatus, wherein the adjustment parameter data received by way of the transmission facility is stored in the memory to implement a fine tuning of the hearing apparatus without a loss of the basic setting for the individual hearing loss, and wherein the transponder comprises an adjusting element for manually adjusting the parameter transmitted to the hearing apparatus by way of the transponder.

2. The hearing apparatus as claimed in claim 1, wherein the external transponder is passive and the energy for a data transmission exclusively originates from the hearing apparatus with the aid of the transmission facility.

3. The hearing apparatus as claimed in claim 1, further comprises a signal processing facility which uses the stored programming data to program the hearing apparatus to implement the fine tuning of the hearing apparatus, wherein a plurality of transponders comprising a plurality of preadjustments of the hearing apparatus are provided so that a wearer of the hearing apparatus can acquire a corresponding transponder having a favorable adjustment to the wearer, and wherein each of the transponders comprises an actuation element so that the wearer of the hearing aid can individually adjust parameters and transmit the adjusted parameters to the hearing apparatus.

4. A hearing system, comprising:

a hearing apparatus possessing a basic setting for an individual hearing loss, comprising:

a memory for storing programming data of the hearing apparatus, a transmission facility for wireless communication; and a transponder external to the hearing apparatus, the transponder comprising a programming memory having adjustment parameter data, wherein the transmission facility emits activation energy for the external transponder and receives the adjustment parameter data from the transponder, the adjustment parameter data received by way of the transmission facility is stored in the hearing apparatus memory to implement a fine tuning of the hearing apparatus without a loss of the basic setting for the individual hearing loss, and wherein the transponder comprises an adjusting element for manually adjusting the parameter transmitted to the hearing apparatus by way of the transponder.

5. The hearing system as claimed in claim 4, wherein the transponder comprises:

a plurality of predetermined parameters, and a selecting element for manually selecting the predetermined parameter transmitted to the hearing apparatus as the adjustment parameter data by way of the transponder.

6. The hearing system as claimed in claim 4, further comprising a plurality of different transponders, each comprising different adjustment parameter data for effecting a different selected adjustment for fine tuning of the hearing apparatus.

7. The hearing system as claimed in claim 6, wherein the different adjustment parameter data is limited to specially provided hearing aid features that activate only certain functions.

8. The hearing system as claimed in claim 7, wherein the certain functions comprise activating a directional microphone function or activating a background noise suppression function.

* * * * *